United States Patent [19]

Terrien et al.

[11] 4,413,369

[45] Nov. 8, 1983

[54] AUTOMATIC DEVICE FOR LAP-JOINT ENGAGEMENT OF TWO BRIDGE ELEMENTS ON INTRADOS OR EXTRADOS AND BRIDGE ELEMENT COMPRISING IT

[75] Inventors: Michel E. Terrien; Claude Bouvet, both of Angers, France

[73] Assignee: Etat Francais, Paris, France

[21] Appl. No.: 291,453

[22] Filed: Aug. 10, 1981

[30] Foreign Application Priority Data

Oct. 21, 1980 [FR] France ..... 80.18256

[51] Int. Cl.[3] ..... E01D 15/14; E01D 15/12

[52] U.S. Cl. ..... 14/27; 14/2.4; 14/2.6

[58] Field of Search ..... 14/27, 2.4, 2.6; 52/706, 708

[56] References Cited

U.S. PATENT DOCUMENTS

| | | | |
|---|---|---|---|
| 2,291,078 | 7/1942 | Harris | 14/27 X |
| 3,021,544 | 2/1962 | Gillois | 14/27 |
| 3,036,539 | 5/1962 | Storey | 14/27 X |
| 3,073,271 | 1/1963 | Brill | 14/27 X |
| 3,691,974 | 9/1972 | Sieford | 14/27 X |
| 4,177,531 | 12/1979 | Illgner | 14/27 |
| 4,297,759 | 11/1981 | Soffge | 14/27 X |

*Primary Examiner*—Nile C. Byers, Jr.

*Attorney, Agent, or Firm*—Parkhurst & Oliff

[57] ABSTRACT

The present invention relates to means for the lap joint connection of two bridge elements to each other on intrados or extrados, the lower bridge element being capable of becoming the upper element and vice versa. A first bridge element according to the invention has movable fingers (1, 2) which can retract into the structure of the bridge or protrude therefrom into a position in which they cooperated with boreholes (11, 12) in a second bridge element, in which holes they can be locked. This invention may be used for the construction of floating or nonfloating bridges of any length.

6 Claims, 5 Drawing Figures

AUTOMATIC DEVICE FOR LAP-JOINT ENGAGEMENT OF TWO BRIDGE ELEMENTS ON INTRADOS OR EXTRADOS AND BRIDGE ELEMENT COMPRISING IT

The present invention lies within the technical field of fixed or floating bridges, and more precisely, of means for connecting two bridge elements to each other.

Numerous devices have already been proposed in this field. French Pat. No. 2 158 618 discloses a device for the lap assembling of two bridge elements, that is to say, an assembly in which the two elements to be assembled are superimposed at their ends. This device comprises a ball suspended from a tackle chain in order to assemble the two elements and fixed protruding spherical centering pins engaged in funnels. The locking is effected by an annexed set of hooks actuated by jacks.

The primary function of this device is to pick up and deposit a bridge element, and it requires manual labor to put the grasping balls in place. In certain useages, the non-effacing centering pins may be subjected to damage.

German Pat. No. 1 124 383 describes a device for assembling two bridge elements end to end which requires manual operation in order to put the locking pins in place.

Other devices used on bridging equipment are also known.

However, all of these devices, depending on their type, comprise straps, yokes, and hooks or mechanical or hydraulic spindles serving both as assembler and interlocker. These arrangements are not always protected from dirt and are at times subjected to extensive damage due to vehicular traffic. These problems make the unlocking and disassembling operations of the bridge elements difficult. Furthermore, most of these devices are put in place manually, although some of them are semi-automatic.

One of the objects of the present invention is to provide an engagement device which makes it possible to keep bridge elements assembled and locked to each other (so-called lap assembly). Bridge elements such as walkways, beams, joists, and ramps extended from fixed or floating supports so as to construct a structure in which it is possible for vehicles to pass over any type of gap while avoiding the drawbacks inherent in the previous arrangements.

Another object of the invention is to reduce the time required in order to place a bridge in use. This is accomplished by installing an automatic interlock after assembly.

Another object of the invention is to assure continuity of the roadway formed by the different assembled elements, as well as to permit the assembly of completely identical elements without particularization.

Another object of the invention is to permit lap assembling, that is to say, assembling by superimposing the ends of the elements either on the extrados of one element or on the intrados of one element, depending on the circumstances, without having to modify or adapt each element in accordance with the position selected.

The object of the invention is therefore an automatic device for the lap engagement of two bridge elements either on extrados or on intrados, the lower bridge element being capable of becoming the upper element and vice versa, such that a first bridge element has a set of fingers movable from a first position in which they are retracted in the plane of the bridge element toward two second positions in which the fingers protrude either on the intrados or on the extrados and such that the second bridge element has boreholes which debouch on both sides on its intrados and its extrados and are intended to receive the centering fingers of the first element and, in combination, a set of bolts for blocking the fingers of the first element in the assembled position, and that the movable fingers of the first element are integral with a shaft perpendicular to the longitudinal axis of the bridge element and movable in rotation under the action of a motor in order to bring the fingers from their first position toward one of the two locking positions.

In accordance with the invention, the bolts of the second element are arranged within the cross section of the bridge element in such a manner that the locking pins pass through boreholes provided in the centering fingers after assembly.

In accordance with a variant embodiment, the centering fingers have frustoconical ends, the boreholes of the second element having a biconical shape flared toward the extrados and the intrados in order to facilitate the centering.

Another object of the invention is a bridge element having an assembly device such as described above and comprising at one of its ends at least one set of centering fingers which is arranged perpendicular to its longitudinal axis and at its opposite end at least one set of boreholes extending through the intrados and the extrados of the element.

The invention will be better understood from the additional description given below with reference to the accompanying drawings, in which.

Figure 1:
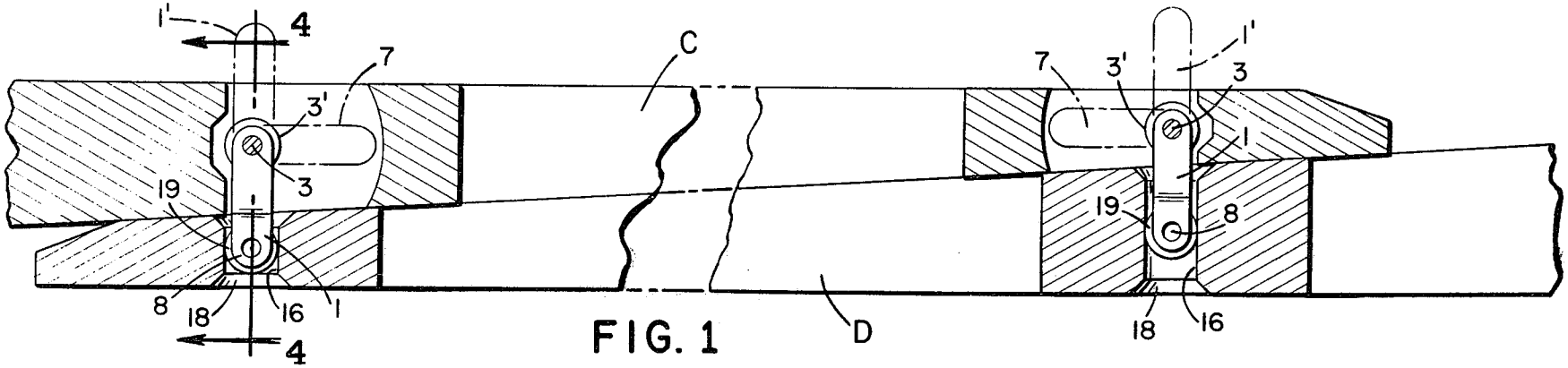
FIG. 1 is a longitudinal section through the end of two assembled bridge elements according to one embodiment of the invention.
Figure 2:
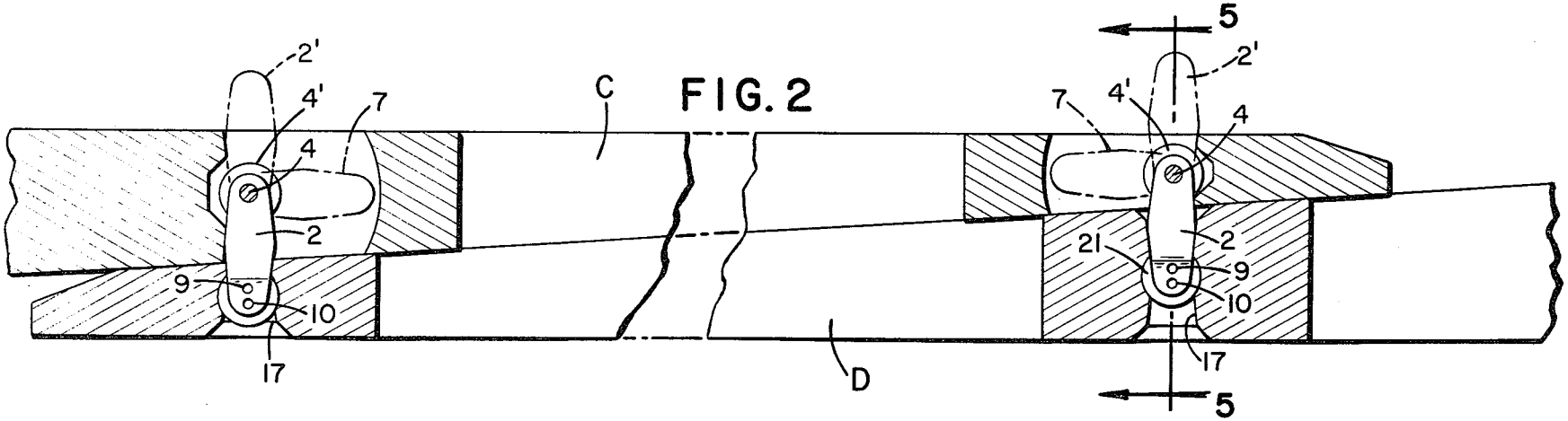
FIG. 2 shows a longitudinal section through the end of two assembled bridge elements of a second embodiment of the invention.
Figure 3:
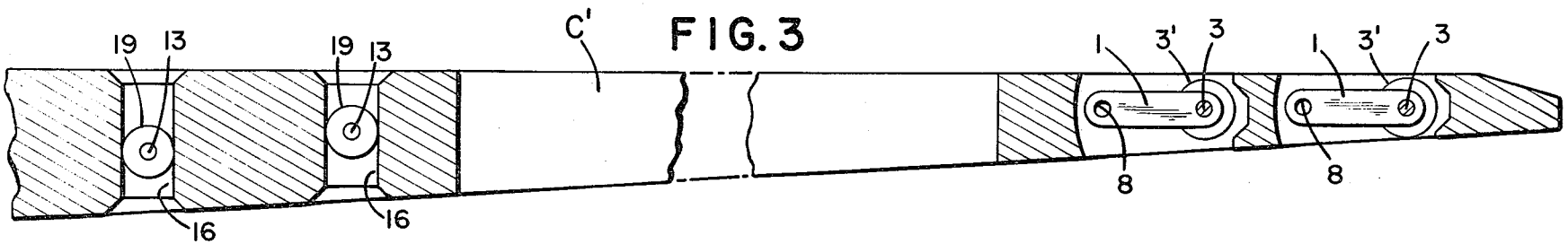
FIG. 3 shows a single bridge element of FIG. 1.
Figure 4:
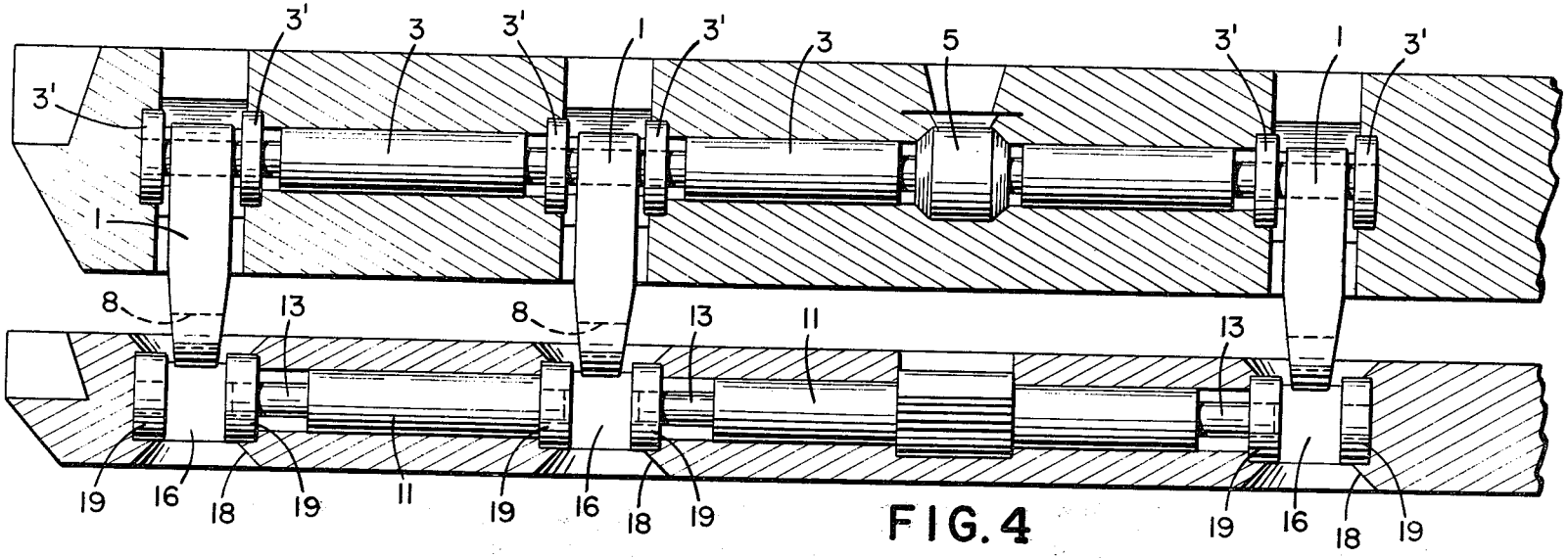
FIG. 4 shows a half-section along the lines 4 of FIG. 1 perpendicular to the longitudinal axis of the elements during the course of assembly.
Figure 5:
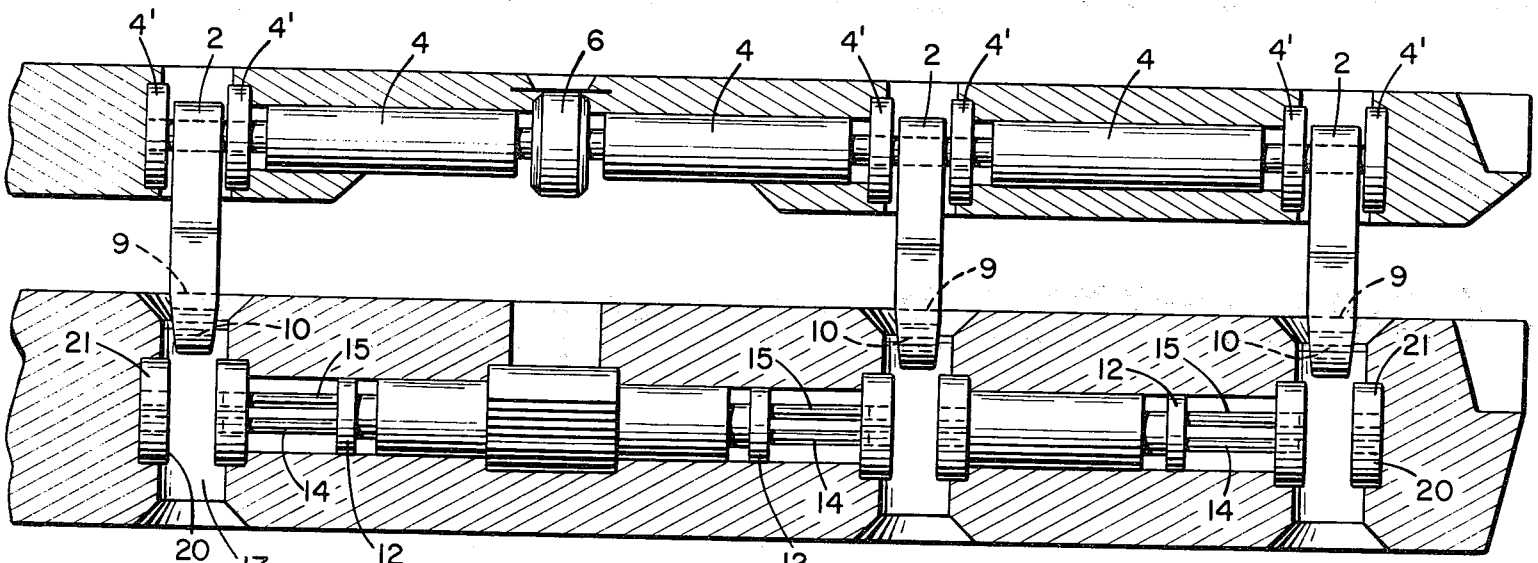
FIG. 5 shows a half-section along the lines 5 of FIG. 2.

As can be noted from the Figures, the two elements C and D are overlapped and the element C has two rows of fingers 1 and 2 arranged along an axis perpendicular to the longitudinal axis of the bridge elements. The centering and locking fingers 1 and 2 are borne by two shafts 3 and 4 mounted on bearings 3' and 4' in the center of the element C and made movable in rotation by motors 5 and 6 driven by any suitable means.

The motors 5 and 6 may rotate in both directions or may be provided on their output shaft with a direction reversing device in such a manner that the fingers 1 and 2 can move from their position of rest 7 within the elements C and D up to an assembly position either on the intrados, or on the extrados for a reverse mounting of the elements C and D.

The fingers 1 are provided with boreholes 8 cooperating with the bolts of the element D which will be described below, and the fingers 2 in a variant embodiment have two boreholes 9 and 10.

The element D comprises two rows of bolts 11 and 12 cooperating with the fingers 1 and 2. These bolts have either a locking pin 13 (for the bolts 11) or two locking pins 14 and 15 (for the bolts 12) which can be maneuvered automatically by any suitable means.

The bolts are arranged in such a manner that they debouch into boreholes or passageways 16 and 17 which are intended to receive the fingers 1 and 2.

Depending on the shape of the fingers (cylindrical in the case of the finger 1 and conical in the case of the finger 2), the boreholes 16 will be cylindrical and have a centering bevel 18, or they will be biconical (boreholes 17) so as to assure perfect positioning of the elements with respect to each other.

In order to assemble the elements C and D the fingers 1 and 2 are moved in the proper direction depending on the positioning desired for the elements. The elements are then placed in overlapping position, the fingers 1 and 2 assuring the proper centering of the beams. When the beam C rests on D, the bolts 11 and 12 are actuated. The fingers 13, 14 and 15 then position themselves in the boreholes 8, 9 and 10 thus assuring that the assembly of the two elements is maintained.

The fingers 13, 14 and 15 can be suitably dimensioned in such a manner that upon locking, their length is sufficiently great to pass through the fingers 1 and 2 and rest in bearings 19, 20 and 21 so as to cause the beam itself to participate in the resistance to stresses.

A bridge element in accordance with the invention may comprise, at one of its ends, one or more rows of centering fingers 1 and/or 2 while its other end will include bolts 11 and/or 12, the only assembly requirement being to have the same number of rows of bolts as there are corresponding fingers.

Thus, a bridge can be erected simply by using elements which are identical, which can be placed as desired either in a upper position or in a lower position, without any worry as to a problem of fit.

The invention therefore can advantageously be used to construct bridges of all lengths.

We claim:

1. A connecting device for permitting the lap joint connection of a first bridge element and a second bridge element, on intrados or extrados, wherein the first bridge element includes a plurality of fingers, movable from a first position in which they are retracted into the plane of the first bridge element and toward two second positions in which the fingers protrude either on the intrados or on the extrados; and a shaft which is integral with said set of fingers and which is perpendicular to the longitudinal axis of the first bridge element;

the second bridge element includes a plurality of passageways debouching on the intrados and extrados, said passageways being adapted to receive the fingers;

a plurality of bolts which cooperate with said plurality of passageways to lock the fingers in an interlock position; and a motor which rotates said shaft so as to move the fingers from an unlocked position to the interlock position.

2. A connecting device according to claim 1, wherein the fingers have at least one passageway perpendicular to their longitudinal axis which cooperates with at least one locking pin of said bolts.

3. A connecting device according to claim 2, wherein said bolts are disposed within a cross section of the second bridge element in such a manner that the locking pins after assembly to said interlocking position pass through the plurality of boreholes provided in the fingers.

4. A connecting device according to claim 3, wherein the fingers have frustoconical ends, and the boreholes of the second element have a bi-frustoconical shape flared toward the extrados and the intrados.

5. A bridge element to be used in an automatic device as recited in claim 4, wherein one end of the bridge element has at least one set of centering fingers arranged perpendicular to its longitudinal axis and an opposite end has at least one set of boreholes debouching throughout.

6. A bridge element according to claim 5, wherein the opposite end of the bridge element has at least one set of centering holes.

* * * * *